US006606471B2

(12) United States Patent
Kamei et al.

(10) Patent No.: US 6,606,471 B2
(45) Date of Patent: Aug. 12, 2003

(54) IMAGE FORMING APPARATUS

(75) Inventors: Yukikazu Kamei, Ichihara (JP); Tomohiro Oikawa, Funabashi (JP); Shirou Wakahara, Sakura (JP); Hideki Onishi, Chiba (JP); Hiroshi Doshoda, Chiba (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/968,148

(22) Filed: Oct. 1, 2001

(65) Prior Publication Data

US 2002/0039499 A1 Apr. 4, 2002

(30) Foreign Application Priority Data

Oct. 2, 2000 (JP) ..... 2000-302267

(51) Int. Cl.[7] ..... G03G 15/02
(52) U.S. Cl. ..... 399/174; 399/176
(58) Field of Search ..... 399/174, 176, 399/313, 148; 361/221, 225; 430/902

(56) References Cited

U.S. PATENT DOCUMENTS 4,360,262 A * 11/1982 Genthe ..... 399/148
5,678,145 A 10/1997 Snelling et al. ..... 399/176
5,929,136 A * 7/1999 Snelling et al. ..... 399/176 X

FOREIGN PATENT DOCUMENTS

JP 62-251779 * 11/1987
JP 10-48923 2/1989
JP 2000-122385 * 4/2000

OTHER PUBLICATIONS

U.S. patent application Ser. No. 09/883,656, filed Jun. 18, 2001; "*Image Forming Apparatus With a Transfer Device*".

* cited by examiner

*Primary Examiner*—Sophia S. Chen
(74) *Attorney, Agent, or Firm*—Edwards & Angell, LLP; David C. Conlin; George W. Hartnell, III

(57) ABSTRACT

The present invention relates to an image forming apparatus with a charging member which charges an image bearer with a photoconductive surface. Forming a layer containing ferroelectric as part on the charging member, and applying the electric field formed by dipoles of the ferroelectric, the photosensitive member surface is electrified, thereby downsizing a charger and reducing power consumption thereof are achieved for realizing low-cost and reducing the number of consumable parts sufficiently.

19 Claims, 5 Drawing Sheets

IMAGE FORMING APPARATUS

BACKGROUND OF THE INVENTION (1) Field of the Invention

The present invention relates to an image forming apparatus with a charging member which charges an image bearer with a photoconductive surface, and preferably relates to an image forming apparatus having a charging member in which a ferroelectric layer subjected to a dipole orienting treatment (poling treatment) is formed on a surface opposing to the image bearer, such as a copier, laser beam printer and other image recording apparatus including liquid development process.

(2) Description of the Prior Art

Generally, an electrophotographic image forming apparatus such as a copier, laser printer or the like comprises seven processing units as shown in FIG. 6: a photosensitive member 101 as an image bearer; a charger 102 for charging the photosensitive member 101; an exposure unit 103 for forming a latent image by light exposure; a developing unit 104 for performing development with toner; a transfer device 105 for transferring the toner image to a transfer medium; a fixing device (not shown) for fixing the toner image on transfer medium; an erasing device 106 for erasing charge on the photosensitive member; and a cleaning unit 107 for removing the leftover toner from the photosensitive member.

In recent years, various contact type charging devices have been developed in place of corona chargers in order to provide an ozoneless, low-cost, compact, and energy saving configuration for the charging member 102. In this contact type charging device, the charging member applied with a voltage is set in abutment with the photosensitive member so that the photosensitive member surface is charged by a discharge phenomenon or the like, and a charging roller type in which a conductive roller is used as a charging member is preferable in terms of the stability of electrification.

Since a charging phenomenon is conducted by discharging from the charging member to the photosensitive member, electrification is started by applying a voltage equal to or higher than the threshold voltage by a voltage power supply 108. For example, when a charging roller is pressurized to contact with an OPC photosensitive member with the thickness of 25 $\mu$m and applied with a voltage of about 700V or higher, the surface potential of the photosensitive member starts to increase, thereafter the surface potential of the photosensitive member linearly increases with the applied voltage with a gradient of 1.

Hereinbelow, the threshold voltage is defined as the electrification start voltage Vth. That is, in order to obtain the surface potential of the photosensitive member VoPc necessary for electrophotography, the charging roller needs a DC voltage equal to (VoPc+Vth) or higher. The charging roller has a roller configuration made of a metal core of aluminum, iron or the like, which is covered with an electrically conductive tubular elastomeric element or an electrically insulative tubular elastomeric element (polyurethane, EPDM, silicone rubber, NBR, etc. ) in which a conductor (ionic conductors, carbon black, metal oxides, metal powders, graphite, etc.) is dispersed. This roller (to be referred to hereinbelow as "charging roller") is set in abutment with the photosensitive member surface and a bias voltage of +(−)500 V or higher is applied to the metal core, or the DC bias component superimposed with an AC bias component, for example 1.6 kVpp, is applied if necessary, so that the surface of the photosensitive member is uniformly charged at about +(−) 600V.

However, the conventional charging means, wherein a bias voltage is applied to the metal core of the charging roller, requires a bias application means, therefore a high-voltage power supply is needed, which leads to increase in the cost of the apparatus, increase in apparatus size for installing the power source, increase in consumption of power and increase in the number of consumable parts, results in inconsistency with regard to energy saving and ecologically-oriented development, which have become increasingly important for manufactures.

Therefore, in order to obtain a charging device having no need for a high-voltage power supply, as disclosed in Japanese Patent Application 48923/1999, a conductive roll support structure with a pyroelectric film layer is set into contact with a photoconductive surface member, and the pyroelectric film is provided with a heater which contacts with the pyroelectric film to heat it. Thereby, the pyroelectric film is heated, and by heating and cooling it, thermal expansion or thermal contraction occurs, thereby, the surface charge density is changed. Using this change, the pyroelectric potential is generated on the pyroelectric film for charging the photoconductive member as needed before exposing the photoconductive member. As above, a method was proposed, wherein using the piezoelectric effect of the pyroelectric film the pyroelectric potential is generated in the pyroelectric film, thereby, the photoconductive surface is charged.

However, even if the method in Japanese Patent Application 48923/1999 is used, in order to generate the pyroelectric potential by the pyroelectric film, it is necessary to set a heating mechanism for heating the pyroelectric film, furthermore, heating needs to be carried out by the heating mechanism, which thereby leads to an increase in consumption of power and it does not successfully achieve the essential improvement in regards to energy-saving, low-cost, downsizing, etc.

SUMMARY OF THE INVENTION

The present invention has been achieved in order to solve the above problems with the conventional technology, it is therefore an object of the present invention to provide an image forming apparatus capable of realizing low-cost and reduction of the number of consumable parts by downsizing a charger and reducing power consumption thereof.

The inventors hereof have earnestly studied and as a result, have successfully completed the invention by developing a process for uniformly charging the photosensitive member surface, by using a ferroelectric for the charging device in an electrophotographic process for applying the electric field formed by permanent dipoles in a ferroelectric. That is, the photosensitive member surface is uniformly electrified by the electric field formed by permanent dipoles of the ferroelectric, which conducts a different process from the conventional one, and the charging device does not need to be provided with a high-voltage power supply for applying a bias potential for electrification. Thus, energy-saving, low-cost and downsizing in the charging device was successfully realized.

Therefore, in a charging member for electrifying the surface of a photosensitive member which is an image bearer, by forming a layer, for example a ferroelectric layer, subjected to a dipole orienting treatment (poling treatment) on the surface layer of the charging member which is contacted with the photosensitive member, and developing a new electrifying process for electrifying uniformly the photosensitive member surface by the function of the electric field formed by dipoles in the charging member, an image forming apparatus is provided to achieve the above object.

The present invention for attaining the above object is configured as the following aspects from 1 to 19:

In accordance with the first aspect of the present invention, an image forming apparatus with a charging member for electrifying an image bearer which has a photoconductive surface is characterized in that the charging member is arranged opposing to the image bearer and has a layer containing the ferroelectric at least as part, the ferroelectric is subjected to a dipole orienting treatment in advance, wherein the photoconductive surface of the image bearer is electrified by electric field formed by the dipoles of the ferroelectric.

In accordance with the second aspect of the present invention, the image forming apparatus having the above first aspect is characterized in that the bias voltage applying means for electrifying is not provided to the charging member.

In accordance with the third aspect of the present. invention, the image forming apparatus having the above first or second aspect is characterized in that the charging member is constructed such that the ferroelectric layer is formed on an electrically conductive support.

In accordance with the fourth aspect of the present invention, the image forming apparatus having the above third aspect is characterized in that the electrically conductive support is grounded.

In accordance with the fifth aspect of the present invention, the image forming apparatus having any one of the above first through fourth aspects is characterized in that the polarity of the ferroelectric layer is set positive when the toner on the image bearer is charged negative and the polarity of the ferroelectric layer is set negative when the toner on the image bearer is charged positive.

In accordance with the sixth aspect of the present invention, the image forming apparatus having any one of the above first through fourth aspects is characterized in that the thickness of the ferroelectric layer is 24 $\mu$m or greater.

In accordance with the seventh aspect of the present invention, the image forming apparatus having any one of the above first through sixth aspects is characterized in that the ferroelectric layer includes at least an organic material as part thereof.

In accordance with the eighth aspect of the present invention, the image forming apparatus having the above seventh aspect is characterized in that the organic material is poly vinylidene fluoride-tetrafluoroethylene copolymer [P(VDF-TeFE)].

In accordance with the ninth aspect of the present invention, the image forming apparatus having the above seventh aspect is characterized in that the organic material is poly vinylidene fluoride-trifluoroethylene copolymers [P(VDF-TrFE)].

In accordance with the tenth aspect of the present invention, the image forming apparatus having any one of the above first through sixth aspects is characterized in that the ferroelectric at least includes an inorganic material as part thereof.

In accordance with the eleventh aspect of the present invention, the image forming apparatus having the above tenth aspect is characterized in that the inorganic material is a ceramics sintered compact composed of at least three components which are given as a general form of $[(Bi_2O_2)^{2+}(XY_2O_7)^{2-}]$ or given in a general form of $[X_nBi_4Ti_{n+3}O_{3n+12}]$ where X represents Sr, Pb, Ba or $Na_{0.5}Bi_{0.5}$, Y represents Ta or Nb, and n represents 1 or 2.

In accordance with the twelfth aspect of the present invention, the image forming apparatus having the above eleventh aspect is characterized in that the ceramics sintered compact are composed of bismuth-strontium titanate.

In accordance with the thirteenth aspect of the present invention, the image forming apparatus having any one of the above first through sixth aspects is characterized in that an abrasive-resistant material covers or coats the surface layer of the ferroelectric.

In accordance with the fourteenth aspect of the present invention, the image forming apparatus having any one of the above first through sixth aspects is characterized in that the relative permittivitty es of the ferroelectric is set equal to or greater than 10.

In accordance with the fifteenth aspect of the present invention, the image forming apparatus having any one of the above first through sixth aspects is characterized in that the volume resistivity of the ferroelectric falls within the range from $10^{14}\Omega\cdot$cm to $10^{15}\Omega\cdot$cm.

In accordance with the sixteenth aspect of the present invention, the image forming apparatus having any one of the above first through fifteenth aspects characterized in that the volume resistivity of the conductive support substrate is set to be equal to or lower than $10^{6}\Omega\cdot$cm.

In accordance with the seventeenth aspect of the present invention, the image forming apparatus having any one of the above first through sixteenth aspect is characterized in that the volume resistivity of the ferroelectric is set to be equal to or lower than $10^{12}\Omega\cdot$cm when it is heated within the range below the Curie temperature.

In accordance with the eighteenth aspect of the present invention, the image forming apparatus having any one of the above first through seventeenth aspects is characterized in that the following relationship holds:

$$L \geqq Vp/Vopc$$

where Vp(V/$\mu$m) represents the pyroelectric potential L($\mu$m) represents the thickness of the ferroelectric layer, and Vopc (V) represents the charged potential of the image bearer.

In accordance with the nineteenth aspect of the present invention, the image forming apparatus having any one of the above first through eighteenth aspects is characterized in that the following relationship holds:

$$L>\{Vopc+312+6.2(Lp/\epsilon sP)\}/\{Vp-(6.2/\epsilon s)\}$$

where Lp($\mu$m) represents the thickness of the image bearer, $\epsilon$sP represents the relative permittivity of the image bearer, Vopc(V) represents charged potential of the image bearer, Vp(V/$\mu$m) represents the pyroelectric potential appearing per unit thickness of the ferroelectric layer, L($\mu$m) represents the thickness of the ferroelectric layer, and $\epsilon$s represents the relative permittivity of the ferroelectric.

BRIEF DESCRIPTION OF THE DRAWINGS

The embodiments of the present invention will hereinafter be described in detail with reference to the drawings.

DESCRIPTION OF THE INVENTION

Figure 1:
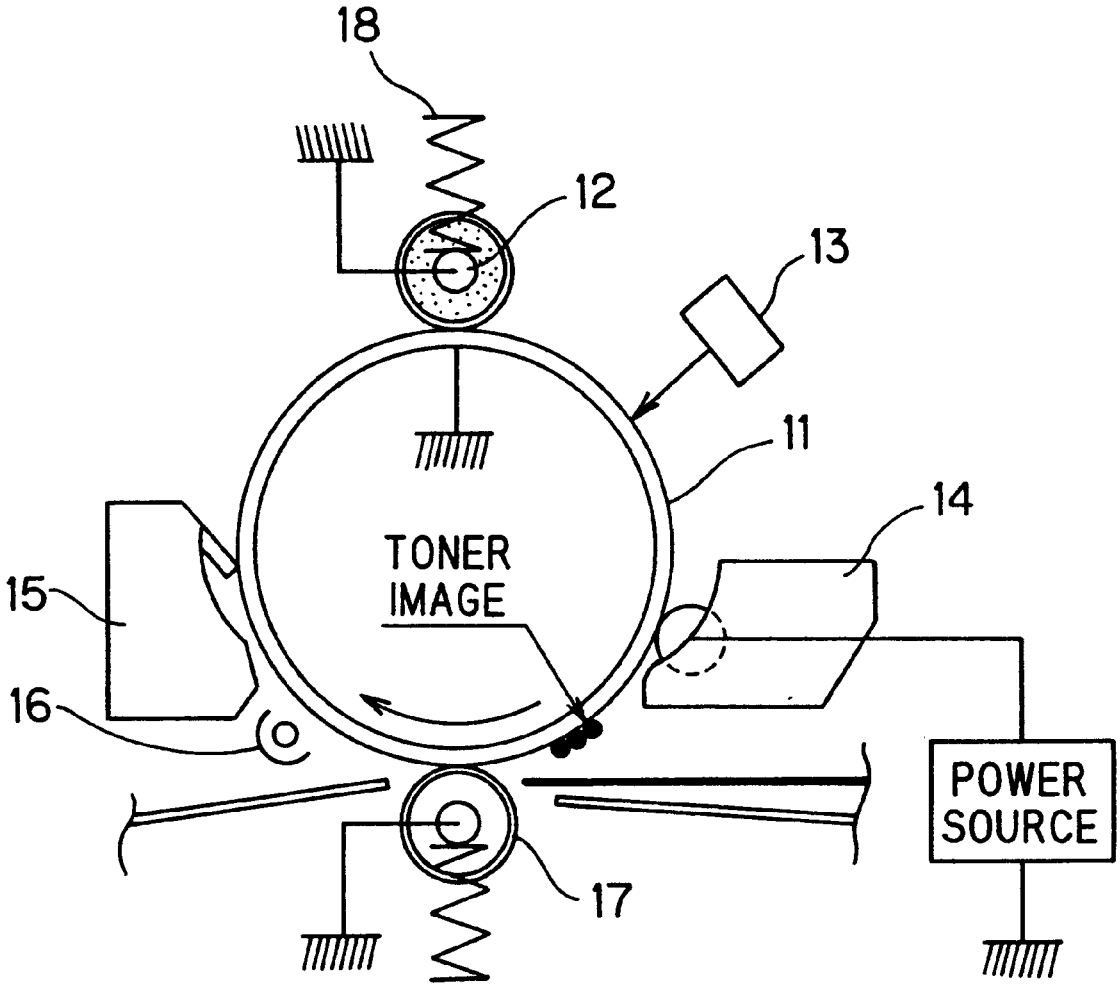
FIG. 1 is a fundamental diagram showing the configuration of an embodiment of an image forming apparatus of the present invention.

As shown in FIG. 1, an image forming apparatus of the present invention has a charging member 12 for electrifying an image bearer 11 with a photoconductive surface, and the charging member 12 is arranged opposing to the image bearer 11. The charging member 12 should not be limited to a roller configuration as shown in the drawing but may be of a blade, plate or endless belt configuration.

Figure 2A:
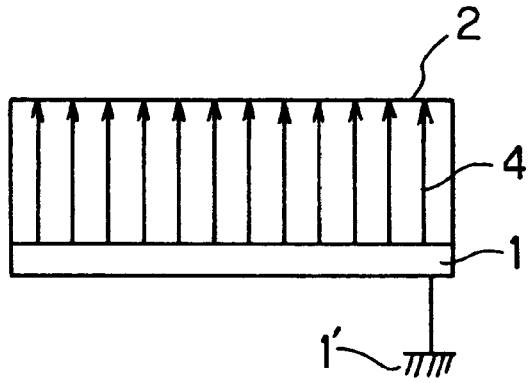
FIGS. 2A, 2B and 2C are diagrams showing various layered configurations of ferroelectrics.
Figure 2B:
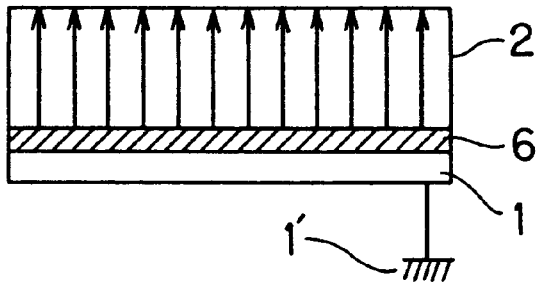
Figure 2C:
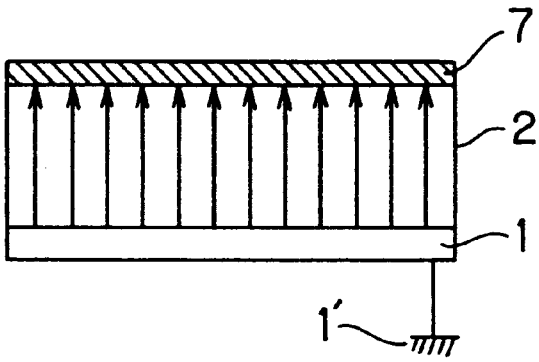

As shown in FIGS. 2A, 2B and 2C, the charging member is formed with a layer 2 including a ferroelectric at least as part and the ferroelectric layer 2 is subjected to the dipole orienting treatment beforehand. And the photoconductive surface of the image bearer 11 is electrified by the electric field formed by the dipoles the ferroelectric.

Therefore, it is not always necessary to provide a high-voltage power source for the charging member as is required conventionally. Since no bias voltage needs to be applied from an external high-voltage power supply and no energy such as external thermal energy needs to be applied, it is possible to realize energy-saving, low-cost and downsizing.

That is, the charging member is characterized in that it is not provided with a bias voltage applying means for electrification. Since no external energy such as high voltage or thermal energy needs to be applied, it is possible to realize energy-saving As shown in FIG. 2, it is preferable for the configuration of the charging member 12 that the ferroelectric layer 2 is formed on the conductive support layer 1. The ferroelectric layer 2 and conductive support substrate 1 may be formed in close contact with each other (FIG. 2A) or an intermediate layer 6 may be interposed between the ferroelectric layer 2 and conductive support substrate 1 (FIG. 2B). It is further preferred that the surface layer of the ferroelectric layer 2 may be covered with, coated with, or dipped in an abrasive-resistant element 7 (FIG. 2C).

By forming the ferroelectric layer 2 on the conductive support layer 1, it is possible to leak the unnecessary real charge residing on the surface of the ferroelectric layer 2 to the ground via the conductive support 1 during poling treatment which will be described later, whereby an arbitrary surface potential owing to permanent dipoles 4 can be made to appear easily.

Therefore, it is preferable that the conductive support 1 wherein the ferroelectric layer is formed is grounded 1'.

It is preferred that the surface layer of the ferroelectric may be covered or coated with an abrasive-resistant material 7. By covering or coating the surface layer of the ferroelectric with an abrasive-resistant material, it is possible to provide a charging member that has a high durability, with no risk of the ferroelectric wearing and without the necessity of a high-voltage power source.

The material of conductive support layer 1 should not be particularly limited and any material can be used as long as it has a necessary mechanical strength and conductivity. In terms of workability and shape stability, adhesiveness to the ferroelectric element, for example, metals such as anodized aluminum ($Al_2O_3$), etc., conductive inorganic substance such as conductive polymer and carbon black, and conductive rubber and conductive plastic in which a conductive agent such as carbon black, a metal oxide, metal powder, ion conducting agent or graphite has been filled when vulcanized, may be used.

The abrasive-resistant element 7 (such as polyester, teflon, nylon resin and the like) may cover the ferroelectric layer 2 or the ferroelectric layer 2 may be coated by dissolving an organic powder such as polymethyl butyral, poly-methyl methacrylate or the like, in a volatile solvent and spraying, direct coating, or dipping with the solvent as a coating agent.

The ferroelectric layer formed on the charging member of the image forming apparatus in the present invention is made up of molecules of permanent electric dipoles so as to have spontaneous polarization. Ferroelectrics can be classified, into two main groups, order-disorder and displacive, according to the mechanism of formation of spontaneous polarization.

The order-disorder class of ferroelectrics includes substances which transit between the ferroelectric and paraelectric phases as the ordering of the dipole orientation varies. In the ferroelectric phase, since adjacent permanent dipoles are oriented orderly so as not to cancel their dipole moments, the material exhibits spontaneous polarization. In the paraelectric phase, dipole orientation becomes disordered and dipole moments cancel out each other, so that the ferroelectricity disappears resulting in non-polarization. In this way, the dipole orientation is determined by a certain combination of the degree of the tendency of adjacent dipoles to be aligned with each other and that of their entropic tendency to become disordered.

Examples of the organic materials for forming the ferroelectrics in order-disorder class may include: polymers of vinylidene fluorides, other resins having intermolecular hydrogen bonds therein and containing organic compounds with amino-groups and carbonyl groups, cyano-groups, or thiocarbonyl groups. In the resin, amino-groups and carbonyl groups, cyano-groups, or thiocarbonyl groups (hereinbelow referred to as "functional groups") may exist at the principal chain or side-chains. of the resins having these functional groups, resins containing one class of functional group or resins containing two or more classes of functional groups may be used.

Specific examples of materials forming an organic ferroelectric layer include: poly vinylidene fluoride, poly vinylidene fluoride-tetrafluoroethylene copolymers, poly vinylidene fluoride-trifluoroethylene copolymers, polyamides having hydrocarbon chains with an odd number of carbon atoms, polyurethanes having hydrocarbon chains with an odd number of carbon atoms, polyureas having hydrocarbon chains with an odd number of carbon atoms, polythioureas having hydrocarbon chains with an odd number of carbon atoms, polyester, polyacrylonitrile, acrylonitrile-methyl metacrylate copolymer, acrylonitrile-allylcyanide copolymer, polyvinyl-trifluoroacetate, polyethernitrile. Especially fluorocarbon resins such as poly vinylidene fluoride, poly vinylidene fluoride-tetrafluoroethylene copolymers, poly vinylidene fluoride-trifluoroethylene copolymers are preferred. Therefore, the ferroelectric includes at least an organic material as part thereof, specifically, the preferred organic material is poly vinylidene fluoride-tetrafluoroethylene copolymers [P(VDF-TeFE)] or vinylidene fluoride-trifluoroethylene copolymers [P(VDF-TrFE)].

Using the above organic materials, it is possible to orient the permanent dipoles under application of a relatively low biasing coercive field(which is an external electric field having a strength equal to or greater than a certain level so as to cause polarization and varies depending on the constituent polymer, film thickness, ambient atmospheric temperature, etc.), hence it is possible to make stable the poling characteristics of the ferroelectric as well as to provide a high pyroelectric potential stable with respect to temporality.

Using the above poly vinylidene fluoride-tetrafluoroethylene copolymers [P(VDF-TeFE)] or vinylidene fluoride-trifluoroethylene copolymers [P(VDF-TrFE)] polymerized with the molar percentage of poly vinylidene fluoride set at 0 to 100 mol % (more preferably set at 50 to 95 mol %, especially the most preferably 75 to 85 mol %), it is possible to orient the permanent dipoles under application of a relatively low electrification biasing coercive field. It is also possible to make stable the poling characteristics of the ferroelectric as well as to provide a high pyroelectric potential of the ferroelectric layer stable with respect to temporality. Since the copolymer prepared in the above configuration is easily dissolved in a solvent and has excellent crystallinity when it is formed into a thin film, it is possible to obtain uniform pyroelectric potential and unif ormly electrify a body to be electrified.

Ferroelectrics of the displacive class have spontaneous polarization because the center of the positive ion is displaced from the center of the negative ion by a certain small distance. This displacement is small compared to the dimensions of the unit cell. In paraelectric phase, the ferroelectric becomes non-polarity because the centers of positive and negative ions coincide with each other.

Such a displacement between ions occurs due to long-distance interaction resulting from the Coulomb force between dipoles at a transition temperature or below. A ferroelectric of inorganic metal oxide material is given as a general form of $[(Bi_2O_2)^{2+}(XY_2O_7)^{2-}]$ (where X represents Sr, Pb or $Na_{0.5}$ $B_{0.5}$ and Y represents Ta or Nb) or given in a general form of $[X_nBi_4Ti_{n+3}O_{3n+12}]$ (where X represents Sr, Pb, Ba, or $Na_{0.5}$ $B_{0.5}$ and n represents 1 or 2). Barium titanate is a specific example of this.

There fore, the ferroelectric is preferably a ceramics sintered compact composed of at least three components which are given as a general form of $[(Bi_2O_2)^{2+}(XY_2O_7)^{2-}]$ or given in a general form of $[X_nBi_4Ti_{n+3}O_{3n+12}]$ where X represents Sr, Pb, Ba or $Na_{0.5}$ $Bi_{0.5}$, Y represents Ta or Nb, and n represents 1 or 2. The ceramics sintered compact composed of the above three components is preferably bismuth-strontium titanate.

Forming a ferroelectric out of the organic materials, it is possible to orient the permanent dipoles under application of a relatively low biasing coercive field, hence it is possible to make stable the poling characteristics of the ferroelectric as well as to provide a high pyroelectric potential stable with respect to temporality. And by using a ceramics sintered compact composed of the three components as the inorganic material, it is possible to provide a charging roller with high durability. Especially, it is possible to provide a charging member with high durability by using bismuth-strontium titanate($SrBi_4Ti_4O_{15}$) as a ceramics sintered compact composed of three components.

However, ferroelectrics should not be particularly limited and any ferroelectric can be used as long as it has permanent dipoles poled when an electric field equal to or stronger than the coercive field is applied by a charging roller, charging brush, coronal charger or the like and as long as it has the characteristic of presenting a pyroelectric potential at its surface when it is heated at a particular temperature below the Curie temperature by a heating means which will be described later.

A voltage which can produce an electric field in strength greater than the coercive field (which is an external electric field having a strength equal to or greater than a certain level so as to cause polarization and varies depending on the constituent polymer, film thickness, ambient atmospheric temperature, etc.) is applied to the ferroelectric having pyroelectricity, spontaneous polarization and inversion polarization (either by a contact method using roller charging or non-contact method using corona charging) so as to align the permanent dipoles in one direction. This process is called abovementioned dipole orienting treatment or poling treatment.

Once poling treatment has been carried out a constant level of potential, oriented in a constant direction may be maintained semipermanently unless an electric field equal to or greater than the coercive field is applied externally. In order to cause the permanent dipole thus poled in this ferroelectric element to present a pyroelectric surface potential, the whole surface of the ferroelectric element is heated to a particular and desirable temperature (a temperature below the Curie temperature (140° C.), specifically about 100° C., in the present invention, though different depending upon the constituent polymer of the ferroelectric). Then, the ferroelectric element is cooled to room temperature, and the surface potential attributed to the polarized charge of permanent dipoles can be detected on the ferroelectric element surface.

This process will be described in more detail with reference to A to D in FIG. 3.

Figure 3A:
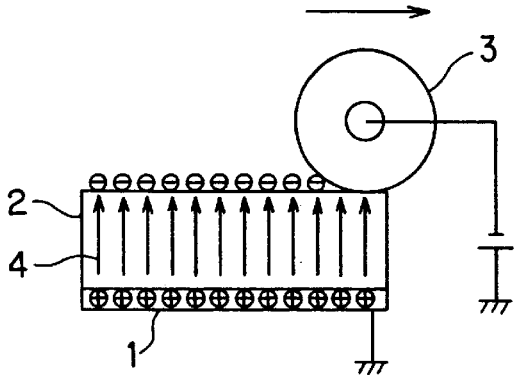
FIGS. 3A, 3B, 3C, and 3D are illustrative views showing a process of dipole orienting treatment in a ferroelectric of a charging member of an image forming apparatus of the present invention.

① In order to positively electrify a ferroelectric 2 formed on a conductive support 1, a contact roller 3 negatively biased (at about −2000V) is set into contact with the ferroelectric to charge it (for poling treatment) After this, since the polarization charge is neutralized by the real charge on the ferroelectric surface, the apparent surface potential on the ferroelectric 2 presents a small value, wherein dipoles 4 are oriented (FIG. 3A).

② The entire surface of ferroelectric element is heated to 100° C. (FIG. 3B).

Figure 3B:
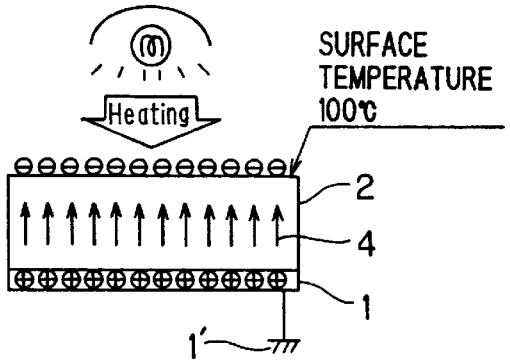

③ This heating partially breaks the orientation of the dipoles 4, the apparent magnitude of dipoles 4 decreases (FIG. 3B).

Figure 3C:
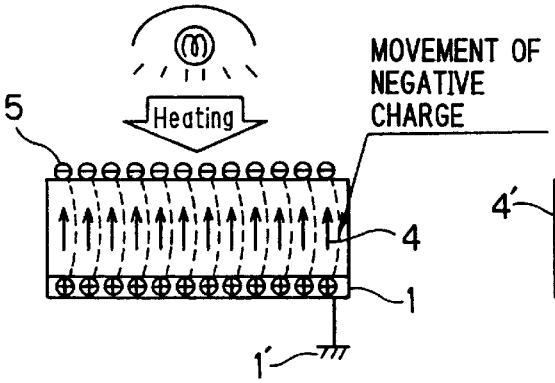

④ Real surface charge 5 unbalanced by the partially broken orientation charge of dipoles 4 leaks out to conductive support substrate 1 as the volume resistivity of ferroelectric 2 lowers due to heat (FIG. 3C). The volume resistivity of ferroelectric 2 by heating is $10^{14}$ to $10^{15}\Omega\cdot$cm at room temperature, and equal to $10^{12}\Omega\cdot$cm or below after heating at 100° C. Therefore, the volume resistivity of ferroelectric used in the invention is preferably within the range from $10^{14}$ to $10^{15}\Omega\cdot$cm, so that it is possible to provide a high pyroelectric potential.

It is also preferable that the volume resistivity of the ferroelectric in the charging member is set to be equal to or lower than $10^{12}\Omega\cdot$cm, especially equal to or lower than $10^{11}\Omega\cdot$cm, when it is heated within the range below the Curie temperature. Setting it within the range, it is possible to leak the unnecessary real charge residing on the ferroelectric surface during poling treatment, which disturbs the orientation of dipoles and does not balance the real charge of the ferroelectric surface. And it is also possible for the ferroelectric surface to provide a high pyroelectric potential owing to permanent dipoles.

Figure 3D:
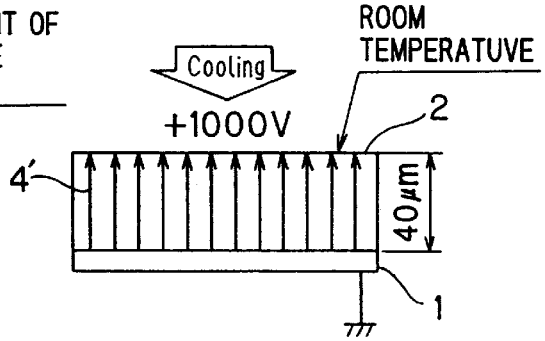

⑤ Cooling to room temperature restores permanent dipoles 4' their original poled state. Since the bulk of the real charge on the surface of ferroelectric element has been canceled by leaking, it does not balance permanent dipoles 4' so that an arbitrary surface potential resulting from permanent dipoles 4' appears (FIG. 3D).

In this case, in order to leak the bulk of the real charge on the ferroelectric element surface, the volume resistivity of the conductive support is set to be equal to or lower than $10^6\Omega\cdot$cm, especially equal to or lower than $10^4\Omega\cdot$cm preferably. If the volume resistivity of the ferroelectric is set so as to fall within the range, it is possible to leak the unnecessary real charge residing on the ferroelectric layer surface to the electrically conductive support during poling treatment, whereby an arbitrary surface potential owing to permanent dipoles can be made to appear. Actually, when leaking the real charge 5 of surface in ④ in accordance with lowering of the volume resistivity by heating by the ferroelectric element, it was possible to leak it well via grounding 1' when the volume resistivity of the conductive support was equal to or lower than $10^6\Omega\cdot$cm.

In the image forming apparatus of the invention, the thickness of the ferroelectric layer is equal to or greater than 24 $\mu$m, preferably 24~100 $\mu$m, more preferably 24~40 $\mu$m. Actually, the film thickness of the ferroelectric element was set at 40 $\mu$m which was within the range, and a surface potential of +1000 V was obtained. If the thickness of the ferroelectric layer is set within the range, the surface potential may be adjusted arbitrarily by varying the parameters such as charging conditions, the material of ferroelectric, film thickness and other factors.

Figure 4:
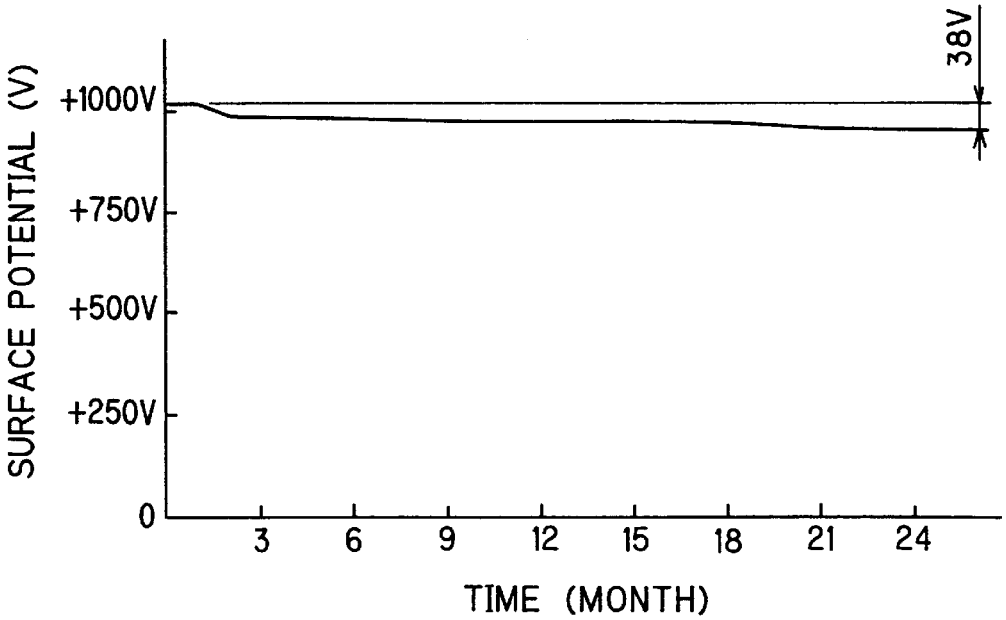
FIG. 4 is a graph showing the variation of the surface potential of the ferroelectric (shown in FIG. 3) with the passage of time.

FIG. 4 shows the relationship of the surface potential of the ferroelectric versus time, determined by allowing the ferroelectric thus obtained by the above process to stand. From FIG. 4, despite the fact that the ferroelectric has been left at room temperature for a long period, specifically, two years, it was found from the measurement of the surface potential that only about 38 V had dropped after two years. Further, the transfer test using the above ferroelectric proved out to provide good images free from practical usage problems.

It was confirmed experimentally that it is possible to electrify the photosensitive member with uniform potential when this ferroelectric element presenting an arbitrary surface potential was used as a charging member and set in abutment with the photosensitive member surface rotatably. Therefore, the surface potential arising on the ferroelectric element is maintained semipermanently so that no high-voltage power source is needed for the charger, whereby excellent electrification can be performed without any necessity for external voltage application, thermal energy or the like.

Next, production methods of organic and inorganic ferroelectric elements will be described below in detail.

<Production Methods of Organic Ferroelectric Elements>

Production methods of organic ferroelectric elements can be basically categorized into three classes as follows:

Class (I): a conductive support layer is formed first, then an organic ferroelectric layer is formed on the support layer Class (II): an organic ferroelectric layer is formed first, then a conductive support layer is formed on the organic ferroelectric layer; and Class (III): an organic ferroelectric layer and a conductive support layer are formed separately, then these two are bonded using conductive adhesive, etc.

The organic ferroelectric element according to the present invention is preferably produced based on the above class (I). However, the production method should not be limited to this, and an optimal production method can be arbitrarily chosen dependent upon the configuration of the charging member used in the image forming apparatus of the present invention, film thickness forming conditions of the ferroelectric element and other factors. Illustratively, when the charging member is of a roller or blade type, a dipping method as mentioned below is preferable while roll coating or spray coating is preferable if the charging member is of a belt type.

One example of the production method of an organic ferroelectric component according to class (I) is described bellow.

Figure 5A:
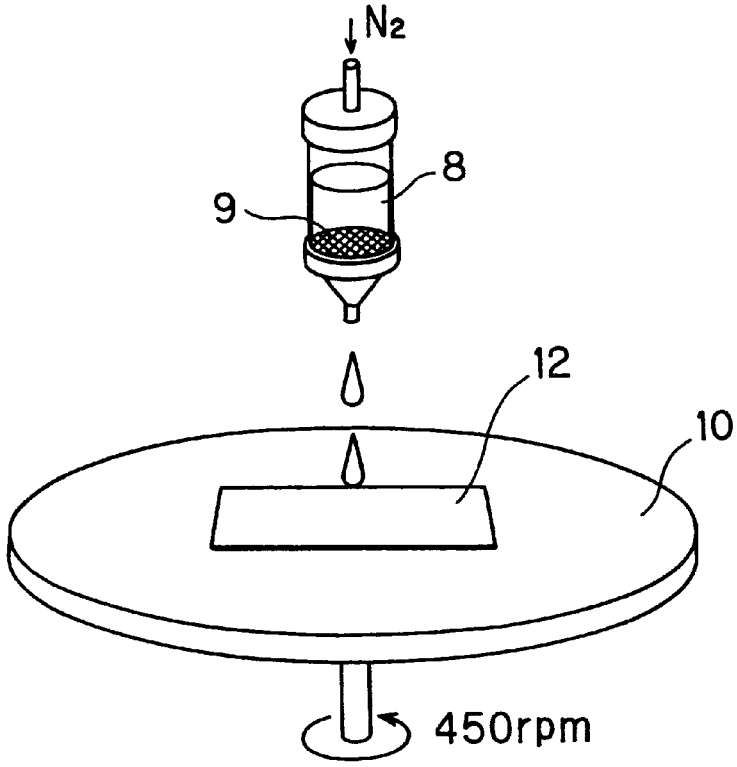
FIGS. 5A and 5B are illustrative views showing an example of producing a charging member according to the present invention.

As shown in FIG. 5(A), the material constituting the organic ferroelectric layer (a copolymer of polyvinylidene fluoride and tetrafluoroethylene or trifluoroethylene, polymerized in a particular molar ratio) is dissolved in a solvent such as acetone to prepare a solution 8. This solution 8 is pressure filtrated through a membrane filter 9 having holes of 5 $\mu$m in diameter using nitrogen gas. The thus filtrated solution is applied dropwise to a conductive substrate 12 (having an arbitrary shape suitable for the charging member: in the present invention for example, a film made of a flexible synthetic resin with a conducting agent such as carbon black dispersed therein, or a belt made of a synthetic resin with a conducting agent such as carbon black dispersed therein) fixed on a rotary disc being rotated at about 450 rpm by a spin coater 10 (MANUAL SPINNER ASS-30, a product of ABLE Corp.) placed in an atmosphere of acetone vapor, so that the solution is spin coated by centrifugal force. Then the resultant is heated at 133° C. for one hour in a heating furnace (Yamato DN64 thermostat: YAMATO SCIENTIFIC CO.,LTD.).

Because the ferroelectric element obtained by the product ion method herein has a complex higher-order structure, with a mix of crystalline and noncrystalline portions, if used directly, the degree of crystallization is too low to present adequate ferroelectricity. However, the heat treatment markedly increases the degree of crystallization so that the ferroelectric element can provide necessary ferroelectricity. This is why the heat treatment should be done. The temperature for this heat treatment may and should be set at a temperature between the melting point (Tm) of the ferroelectric polymer and the Curie temperature (Tc). Though the heat treatment is done at 133° C. for one hour in this embodiment, the heat treatment should not be limited by this condition. That is, the temperature and heating may be adjusted to the conditions suitable for the ferroelectric polymer to be used. The reason for spin coater 10 being used is that control of the film thickness of the ferroelectric is easily made. That is, controlling the rotational speed of spin coater 10 enables the film thickness of the ferroelectric to be adjusted arbitrarily.

The necessary thickness of the ferroelectric layer was about 40 $\mu$m, which was determined based on the relationship with the surface potential after poling. This film thickness could be obtained by setting the rotational speed of spin coater 10 at about 450 rpm. If a thicker film is needed, the rotational speed of spin coater 16 may be reduced. Contrarily, if the film thickness is reduced to sub-micron order, the rotational speed may be increased.

Covering an electrically conductive elastomer formed on the metal core surface with a tube formed with a ferroelectric film obtained by the production method herein, a charging roller 12 (the charging member) shown in FIG. 1 is formed to be used.

Figure 5B:
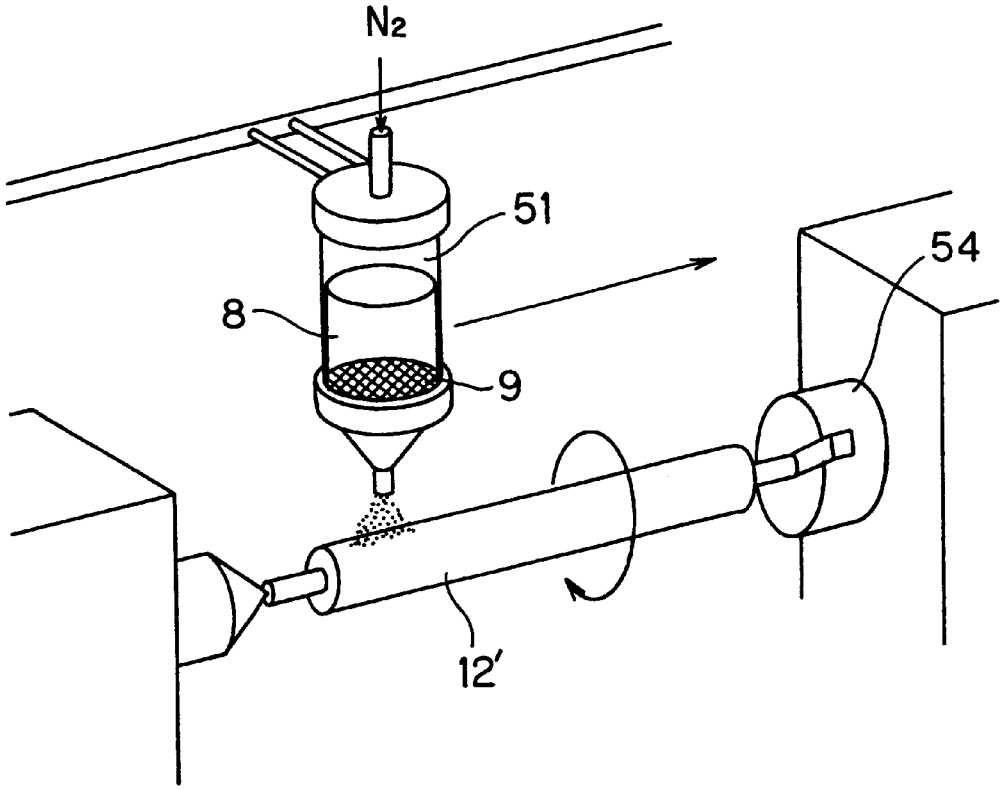
Figure 6:
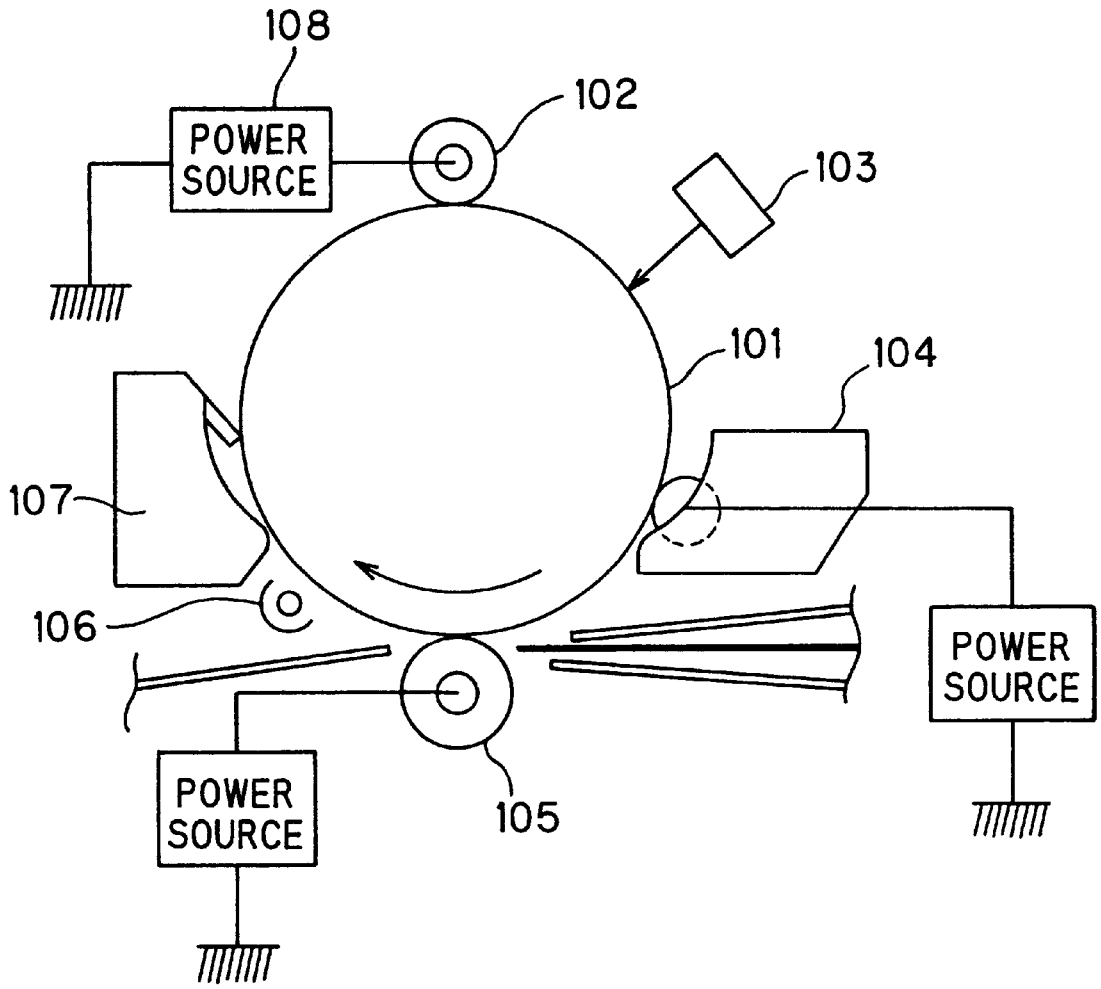
FIG. 6 PRIOR ART
FIG. 6 is a fundamental design showing the configuration of a conventional image forming apparatus.

Other production methods of ferroelectrics of class (I)than the above areas described below. As shown in FIG. 5B, a roller 12' with a metal core on which conductive an elastomer is formed in advance is held by a chuck 54 of a lathe or the like, then rotated at arbitrary rotational speed. In the vicinity thereof, a cartridge 51 filled with the solution 8 is fixed, and pressure filtrated with nitrogen gas to spray while being moved in parallel with the attaching shaft of the charging roller 12'. Thereby, the ferroelectric film is formed on the surface of the charging roller 12'.

There are several other production methods of ferroelectrics of class (I) than the above. One method, for example, comprises the steps of evaporating monomers constituting an organic ferroelectric layer in vacuum, polymerizing them on the conductive support layer 1. Another method may comprise the steps of dissolving the monomers in a solvent, applying the resulting solution to the conductive support layer by dipping, bar coating, spin coating, roll coating, spray coating or the like, then heating to fuse it and rapidly cooling it. Further, a ferroelectric polymer solution may be deposited by vapor deposition, sputtering or the like.

For the conductive support layer, a metal or conductive organic material may be directly used. Alternatively, plastic, rubber and any other insulative substrate in which conductive material is dispersed to give conductivity may be used.

As the production methods of class (II) as categorized above, some specific methods can be mentioned. One method of film forming, for example, comprises the steps of dissolving the material constituting an organic ferroelectric in a solvent, applying the resulting solution to a substrate by dipping, bar-coating, roll-coating, spray-coating, or spin-coating, or depositing the material on a substrate by vapor deposition, sputtering as mentioned before, then heating to fuse it, cooling it rapidly, separating the formed film from the substrate, and subjecting the resultant film, as required, to treatments such as drawing, heating or the like, for providing the necessary ferroelectricity. Another method of film forming comprises the steps of pressing the material constituting an organic ferroelectric layer whilst heating and fusing it to form a film, then cooling the film rapidly, and subjecting it, as required, to treatments such as drawing, heating or the like, for providing the necessary ferroelectricity.

The conductive support layer can be produced by forming a conductive material on the organic ferroelectric layer by application, vapor deposition, ion-coating, or other methods.

As the production methods of class (III) as categorized above, the ferroelectric layer obtained by the production method of class (II) and a substrate such as metal or conductive organic material may be bonded using a conductive adhesive.

<Production Methods of Inorganic Ferroelectric Elements>

Production methods of inorganic ferroelectric elements can be roughly categorized into two classes as follows:

Class (A): a conductive support layer is formed first, then an inorganic ferroelectric layer is formed on the support layer; and Class (B): an inorganic ferroelectric layer and a conductive support layer are formed separately, then these two are bonded The inorganic ferroelectric element according to this embodiment is basically produced by the production method of class (A). However the present invention should not be limited to this method.

As one example of the production method of an inorganic ferroelectric component of the present invention will be described below.

First, 0.763 g of strontium carbonate ($SrCO_3$), 1.652 g of titanium oxide ($TiO_2$) and 4.818 g of bismuth trioxide ($Bi_2O_3$) are mixed sufficiently, and the mixture is sintered at 890° C. for one hour using an electric furnace. The mixture after sintering is ground in a mortar so as to provide $SrBi_4Ti_4O_{15}$ powder. A mixture made up of 50% $SrBi_4Ti_4O_{15}$ powder thus obtained, 2.5% polyvinylbutyral (S-LEC BX-L, a product of SEKISUI CHEMICAL CO., LTD), 47.5% methylethylketon is dispersed and mixed for one hour using ball milling.

The thus obtained dispersed mixture liquid is applied on a conductive substrate (platinum etc.) using a bar coater so that the film thickness will be 40 $\mu$m after drying. Then this is heated and dried at 60° C. for three hours and sintered at 1000 to 1200° C. to forma ferroelectric layer. Thus, the necessary ferroelectric element can be obtained.

There are several production methods other than that of class (A) above. One method of forming a ferroelectric layer, for example, comprises the steps of mixing and dissolving a ferroelectric material and a resin in a solvent, applying the mixed solvent on a conductive substrate by dipping, roll-coating, spray-coating, spin-coating or the like, then removing the solvent. Another method of forming a ferroelectric layer may comprise the steps of dispersing ferroelectric particles in an acetone solution with iodine added thereto and forming a film by electro-deposition. A further method of laminating a ferroelectric may comprise the step of laminating a ferroelectric on a support layer by magnetron sputtering method, laser application method, inorganic metal complex decomposition method (MOCVD) as a chemical vapor deposition or sol-gel processing.

As the production methods of class (B) categorized as above, the ferroelectric element may be formed by forming a ferroelectric film by a solid phase reaction or other method and bonding the film to a support layer using a conductive adhesive. Examples of the resin material to be used for forming a ferroelectric layer include polyvinyl butyral, polyester, polycarbonate, epoxy resin, polymethyl. methacrylate or the like.

The solvent to be used for the mixture solution forming the ferroelectric layer is a solvent which will not affect inorganic oxide ferroelectrics. Any solvent may be used as long as it can dissolve or disperse the above resin materials. Examples of the solvent include ketone type solvents, chlorine type solvents, and aromatic polar solvents.

The ferroelectric elements thus obtained (in a film configuration or in a seamless tubular configuration, or in a solvent configuration for directly coating a charging member, etc.) by the above various production methods are used (to cover, coat, or are bonded along the shape of support substrate of a charging member) to form a charging member properly.

Thereafter, the ferroelectric element is subjected to poling and heating by roller contact charging, etc., as mentioned above so that the element may exhibit the desired pyroelectric potential. The production process may be performed in the reverse order. That is the same performance can be obtained by causing the ferroelectric element to exhibit the desired pyroelectric potential first and then covering, coating, or bonding it over the charging member.

As for the charging process of the ferroelectric element, charging may be performed by bringing a conductive rubber roller to which a high voltage is being applied into contact with the ferroelectric layer and applying a voltage greater than several hundred volts to the conductive rubber roller having a resistivity of about $10^5$ to $10^9 \Omega\cdot$cm, or may be performed by providing brushy, fine fibers having a resistivity of about $10^3$ to $10^5\Omega\cdot$cm on a conductive roller surface and bringing it into enhanced contact with the ferroelectric element. Alternatively, charging may be performed by applying pulsing corona discharges using a corona charger.

As to the heating process, heating may be performed by heat irradiation from a xenon lamp, halogen lamp, etc., by bringing a sheet-like heater into contact, by a high-power laser, by bringing a heat roller into contact or the like.

The charging member 12 thus obtained by the above process is arranged opposing to the photosensitive member 11 in the image forming apparatus as shown in FIG. 1.

A method for contact charging of the photosensitive member 11 is charge injection wherein the electrification start voltage does not appear due to the condition of the photosensitive member surface and the applied voltage is directly proportional to electrifying potential, aerial discharge wherein the electrification start voltage known for Paschen's empirical formula appears, or electrification by the combination of the both. In the configuration of the embodiment, the insulation resistance of the photosensitive member 11 surface is sufficiently secured, so the electrification can be attributed to aerial discharge. When electrifying the photosensitive member 11 which is a member to be electrified at desired charged potential by aerial discharge, the charged potential Vopc(V) of the photosensitive member 11 is given by the following relation:

$$Vopc \leqq Vp \cdot L - [312 + 6.2(Lp/\epsilon sP + L/\epsilon s)]$$

where Lp($\mu$m) represents the thickness of the photosensitive member 11, $\epsilon$sP represents the relative permittivity of the photosensitive member 11, Vp(V/$\mu$m) represents the pyroelectric potential appearing per unit thickness of the ferroelectric, L($\mu$m) represents the thickness of ferroelectric layer, and $\epsilon$s represents the relative permittivity of ferroelectric.

The relative permittivity $\epsilon$s of ferroelectric is preferably set equal to or greater than 10, more preferably equal to or greater than 15. By setting the relative permittivity $\epsilon$s equal to or greater than 10, it is possible to obtain a large polarization charge with a relatively weak electric field and hence provide a high efficient electrification for the image bearer surface.

And it is also desirable that the following relation holds in the ferroelectric:

$$L \geqq Vp/Vopc$$

Since a specific pyroelectric potential is obtained against the thickness of the ferroelectric layer, when electrifying the photosensitive member 11 which is a member to be electrified at desired charged potential, the photoelectric member is surely electrified by forming the ferroelectric with the thickness corresponding to the charged potential.

Furthermore, it is preferable to select the thickness of the ferroelectric layer L to fulfill the following relation:

$$L \geqq \{VoPc + 312 + 6.2(Lp/\epsilon sP)\}/\{Vp - (6.2/\epsilon s)\}$$

In the thus obtained image forming apparatus with a charging member composed of a ferroelectric layer, the photosensitive member surface is electrified by the electric field formed by the dipoles of the ferroelectric, which is different charging process from the conventional one, so that there is no need to provide a high-voltage power source for the charging device. Therefore, since no bias voltage needs to be applied from an external high-voltage power supply, it is possible to provide an energy saving, low-cost, and compact configuration for the charging device.

The polarity of the ferroelectric layer which is sustained by the pyroelectric potential is set negative when the toner on the image bearer is charged negative and the polarity of the ferroelectric layer is set positive when the toner on the image bearer is charged positive. Setting negative (or positive) when the toner is charged negative (or positive), a good toner image is obtained in exposure or developing process after electrifying process for uniformly electrifying the image bearer surface.

Next, the embodiment of the present invention will be described with reference to the drawings.

<Embodiment 1>

FIG. 1 shows the basic configuration of an embodiment of an image forming apparatus of the present invention. However, the present invention should not be limited to this embodiment and it is generally applicable to copiers using an electrophotographic process, laser beam printer, liquid development process and other recording apparatus, etc. for image forming apparatus.

As shown in FIG. 1, in an image forming portion, a grounded, drum-shaped photosensitive member 11 (having an outer diameter of 30 mm) rotating in the direction of the arrow is provided. Arranged around the photosensitive member 11 are a charging member (charging roller) 12 with a ferroelectric layer of the present invention formed on the surface thereof, exposure unit 13, developing unit 14, cleaning unit 15, erasing unit 16 and transfer member 17.

The ferroelectric layer formed on the surface of the charging member 12 presents a uniform pyroelectric potential, for example, +1000 V, owing to permanent dipoles, energizing the charging member 12 against the photosensitive member surface so as to be equal to 1000 g/cm$^2$ or lower by a spring 18, and rotating in accordance with rotation of the photosensitive member 11 and turning it, the photosensitive member 11 is electrified at a desired potential (−600 V) by the charging member 12, then exposed by exposing unit 13 so that a static latent image in accordance with the image data is formed on the photosensitive member 11. The surface potential at exposed areas in the static latent image on photosensitive member 11 is attenuated to approximately 0V. The toner, negatively charged in developing unit 14 is statically attracted to the exposed areas to create a developed image. The toner image area after image development has a surface potential of −200 V.

Transfer member 17 is set in abutment with the photosensitive member surface, rotated in accordance with the rotation of the photosensitive member 11 for carrying the transfer material by a transfer nip part to transfer the toner on the photosensitive member 11 to the transfer media. Thereby, a good recorded image was obtained.

As described above, in the image forming apparatus of the present invention, the charging member is arranged opposing to the image bearer and has a layer containing the ferroelectric at least as part thereof, the ferroelectric is subjected to a dipole orienting treatment in advance, wherein the photoconductive surface member of the image bearer is electrified by the electric field formed by the dipoles of the ferroelectric, thereby downsizing of a charger and reducing power consumption thereof are achieved for realizing low-cost and reducing the number of consumable parts sufficiently.

What is claimed is:

1. An image forming apparatus, including a charging member for electrifying to an image bearer which has a photoconductive surface, comprising;

the charging member arranged opposing to the image bearer and having a layer containing a ferroelectric at least as part thereof, and the ferroelectric subjected to a dipole orienting treatment in advance, wherein the photoconductive surface of the image bearer is electrified by an electric field formed by the dipoles of the ferroelectric.

2. The image forming apparatus according to claim 1, wherein the charging member is set floating without any voltage applied thereto.

3. The image forming apparatus according to claim 1, wherein the charging member is constructed such that the ferroelectric layer is formed on an electrically conductive support.

4. The image forming apparatus according to claim 3, wherein the electrically conductive support is grounded.

5. The image forming apparatus according to claim 3 or 4, wherein the conductive support has a volume resistivity that is set to be equal to or lower than about $10^6\Omega\cdot$cm.

6. The image forming apparatus according to claim 1, wherein polarity of the ferroelectric layer is set positive when the toner on the image bearer is charged negative and polarity of the ferroelectric layer is set negative when the toner on the image bearer is charged positive.

7. The image forming apparatus according to any one of claims 1 through 4, wherein a thickness of the ferroelectric layer is 24 $\mu$m or greater.

8. The image forming apparatus according to any one of claims 1, 2, 3, or 6, wherein the ferroelectric at least includes an organic material as part thereof.

9. The image forming apparatus according to claim 8, wherein the organic material is poly vinylidene fluoride-tetrafluoroethylene copolymer [P(VDF-TeFE)].

10. The image forming apparatus according to claim 8, wherein the organic material is poly vinylidene fluoride-trifluoroethylene copolymers [P(VDF-TrFE)].

11. The image forming apparatus according to any one of claims 1, 2, 3, or 6, wherein the ferroelectric at least includes an inorganic material as part thereof.

12. The image forming apparatus according to claim 11, wherein the inorganic material further comprises an inorganic material being a ceramics sintered compact composed of at least three components which are given as a general form of $[(Bi_2O_2)^{2+}(XY_2O_7)^{2-}]$ or given in a general form of $[X_nBi_4Ti_{n+3}O_{3n+12}]$ where X represents Sr, Pb, Ba or $Na_{0.5}Bi_{0.5}$, Y represents Ta or Nb, and n represents 1 or 2.

13. The image forming apparatus according to claim 12, wherein the ceramics sintered compact are composed of bismuth-strontium titanate.

14. The image forming apparatus according to any one of claims 1, 2, 3, or 6, wherein the surface layer of the ferroelectric may be covered or coated with an abrasive-resistant material.

15. The image forming apparatus according to any one of claims 1, 2, 3, or 6, wherein a relative permittivity $\epsilon s$ of the ferroelectric is set equal to or greater than 10.

16. The image forming apparatus according to claim 1, wherein the ferroelectric has a volume resistivity that falls within the range from about $10^{14}\Omega\cdot$cm to about $10^{15}\Omega\cdot$cm.

17. The image forming apparatus according to any one of claims 1, 2, 3, or 6, wherein the ferroelectric has a volume resistivity that is set to be equal to or lower than about $10^{12}\Omega\cdot$cm when it is heated within the range below the Curie temperature.

18. The image forming apparatus according to any one of claims 1, 2, 3, or 6, wherein the following relationship holds:

$$L \geqq Vp/Vopc$$

where Vp(V/$\mu$m) represents a pyroelectric potential, L($\mu$m) represents the thickness of the ferroelectric layer, and Vopc (V) represents a charged potential of the image bearer.

19. The image forming apparatus according to any one of claims 1, 2, 3, or 6, wherein that the following relationship holds:

$$L \geqq \{Vopc+312+6.2(Lp/\epsilon sP)\}/\{Vp-(6.2/\epsilon s)\}$$

where Lp($\mu$m) represents the thickness of the image bearer, $\epsilon$sP represents a relative permittivity of the image bearer, Vopc(V) represents charged potential of the image bearer, Vp(V/$\mu$m) represents a pyroelectric potential appearing per unit thickness of the ferroelectric layer, L($\mu$m) represents the thickness of the ferroelectric layer, and $\epsilon$s represents a relative permittivity of the ferroelectric.

* * * * *